US010442564B2

(12) United States Patent
Ojima et al.

(10) Patent No.: US 10,442,564 B2
(45) Date of Patent: Oct. 15, 2019

(54) CAN BODY MANUFACTURING METHOD, PRINTING DEVICE, AND BEVERAGE CAN

(71) Applicant: SHOWA ALUMINUM CAN CORPORATION, Tokyo (JP)

(72) Inventors: Shinichi Ojima, Tokyo (JP); Asumi Suwa, Tokyo (JP); Kazunori Ikeda, Tokyo (JP); Tetsuo Kashiwazaki, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 564 days.

(21) Appl. No.: 14/917,993

(22) PCT Filed: Sep. 8, 2014

(86) PCT No.: PCT/JP2014/073678
§ 371 (c)(1),
(2) Date: Mar. 10, 2016

(87) PCT Pub. No.: WO2015/060028
PCT Pub. Date: Apr. 30, 2015

(65) Prior Publication Data

US 2016/0221708 A1 Aug. 4, 2016

(30) Foreign Application Priority Data

Oct. 25, 2013 (JP) ..... 2013-222134

(51) Int. Cl.
*B65D 1/16* (2006.01)
*B41J 3/44* (2006.01)
(Continued)

(52) U.S. Cl.
CPC ..... *B65D 1/165* (2013.01); *B41J 3/4073* (2013.01); *B41M 5/0088* (2013.01);
(Continued)

(58) Field of Classification Search
CPC ..... B65D 1/165; B41J 3/44073
See application file for complete search history.

(56) References Cited

U.S. PATENT DOCUMENTS 5,156,711 A 10/1992 Schwyn
6,135,654 A * 10/2000 Jennel ..... B41J 2/01 101/35
(Continued)

FOREIGN PATENT DOCUMENTS

CN 1051141 A 5/1991
CN 1503733 A 6/2004
(Continued)

OTHER PUBLICATIONS

JP2012056609 translation (Year: 2012).*
(Continued)

*Primary Examiner* — Cachet I Sellman
(74) *Attorney, Agent, or Firm* — Sughrue Mion, PLLC

(57) ABSTRACT

The printing device, first, as shown in FIG. 2A, forms white layers (90) by a first white inkjet head on the surface of the can body (10). Next, as shown in FIG. 2B, irradiation of ultraviolet rays by a first irradiation lamp (261) is performed and the white layers (90) are cured. Then, the can body (10) is moved to a second white inkjet head and, as shown in FIG. 2C, more white ink is loaded on some of the white layers (90) formed by the first white inkjet head. As a result, the thickness of some of the white layers (90) is increased. Next, the can body (10) passes successively under multiple color inkjet heads. As a result, color ink layers (91) are formed on the surface of the can body (10) and the white layers (90), as shown in FIG. 2D.

12 Claims, 6 Drawing Sheets

(51) Int. Cl.

| | |
|---|---|
| ***B41M 5/00*** | (2006.01) |
| ***B65D 25/34*** | (2006.01) |
| ***B41J 3/407*** | (2006.01) |
| *B41M 3/00* | (2006.01) |
| *B41M 7/00* | (2006.01) |

(52) U.S. Cl.
CPC ..... *B65D 25/34* (2013.01); *B41M 3/008* (2013.01); *B41M 7/0081* (2013.01)

(56) References Cited

U.S. PATENT DOCUMENTS

| | | | | |
|---|---|---|---|---|
| 2004/0123444 | A1 | 7/2004 | Lee | |
| 2007/0157559 | A1* | 7/2007 | Till | B41J 2/06 53/411 |
| 2009/0145511 | A1 | 6/2009 | Till | |
| 2009/0205516 | A1* | 8/2009 | Till | B41F 17/18 101/39 |
| 2010/0012252 | A1* | 1/2010 | Till | B65C 3/16 156/64 |
| 2012/0272846 | A1* | 11/2012 | Fleischer | B41F 17/22 101/38.1 |
| 2013/0100186 | A1* | 4/2013 | Kumagai | B41J 2/2117 347/9 |
| 2013/0176358 | A1 | 7/2013 | Yamada et al. | |
| 2014/0028771 | A1* | 1/2014 | Yamada | B41J 2/0057 347/104 |
| 2014/0049585 | A1* | 2/2014 | Tashiro | B41J 3/4073 347/102 |
| 2014/0368841 | A1* | 12/2014 | Ojima | B41F 17/20 358/1.4 |
| 2015/0010722 | A1 | 1/2015 | Yamada et al. | |

FOREIGN PATENT DOCUMENTS

| | | | | |
|---|---|---|---|---|
| CN | 100999152 | A | 7/2007 | |
| EP | 2631191 | A1 * | 8/2013 | B41M 1/04 |
| EP | 2631191 | A1 | 8/2013 | |
| EP | 2810994 | A1 | 12/2014 | |
| JP | 2003-12974 | A | 1/2003 | |
| JP | 2003-019792 | A | 1/2003 | |
| JP | 2006-039013 | A | 2/2006 | |
| JP | 2007-185960 | A | 7/2007 | |
| JP | 2010-500250 | A | 1/2010 | |
| JP | 2010-047308 | A | 3/2010 | |
| JP | 2012-56609 | A | 3/2012 | |
| JP | 2012056609 | A * | 3/2012 | |
| JP | 2012-086870 | A | 5/2012 | |
| JP | 2012-232771 | A | 11/2012 | |
| JP | 2013-132640 | A | 7/2013 | |
| JP | 2013-177571 | A | 9/2013 | |
| WO | 2004/009360 | A1 | 1/2004 | |
| WO | 2012/147695 | A1 | 11/2012 | |
| WO | 2013/099817 | A1 | 7/2013 | |

OTHER PUBLICATIONS

Communication dated Jul. 6, 2017, from the European Patent Office in counterpart European Application No. 14856453.7.

International Search Report for PCT/JP2014/073678 dated Nov. 18, 2014. [PCT/ISA/210].

[Image of Can Body] Suntory Holding Limited, "Canned Kaku Highball" Renewal New Release (issued on Feb. 21, 2012), https://www.suntory.co.jp/news/2012/11326.html, (accessed Jun. 6, 2018); 3 pages.

[Image of Can Body] Suntory Spirits Ltd., Images of "Canned Kaku Highball"; 1 pages.

[Image of Can Body] Kirin Beverage Company, Limited and Red Bull Japan Co., Ltd. concluded a sales agreement for selling "Red Bull Energy Drink" and "Red Bull Sugar Free" at vending machines (issued on Mar. 19, 2013), http:/www.kirin.co.jp/company/news/2013/news2013031901.html, (accessed Jun. 26, 2018), 2 pages.

Machine translation of issued claims of the counterpart Japanese Patent No. JP 6255212.

* cited by examiner

TRANSPARENT PAINT
90
91
10
261
2E
2C
2A
2B
2D
2F

FIG.5

CONTACT ANGLE(° )

| | | EXAMPLE 1 | EXAMPLE 2 | EXAMPLE 3 | COMPARATIVE EXAMPLE 1 | COMPARATIVE EXAMPLE 2 |
|---|---|---|---|---|---|---|
| No. 1 | 1 | 21.0 | 22.5 | 27.5 | 29.5 | 31.0 |
| | 2 | 20.5 | 25.0 | 24.5 | 28.5 | 33.0 |
| | 3 | 22.0 | 24.5 | 26.5 | 29.0 | 35.0 |
| No. 2 | 1 | 19.0 | 24.0 | 25.5 | 28.5 | 31.5 |
| | 2 | 20.5 | 25.0 | 28.0 | 30.5 | 31.0 |
| | 3 | 17.0 | 24.5 | 24.5 | 31.0 | 32.5 |
| AVERAGE | | 20.0 | 24.2 | 26.1 | 29.5 | 32.3 |
| MAXIMUM VALUE | | 22.0 | 25.0 | 28.0 | 31.0 | 35.0 |
| SMALLEST VALUE | | 17.0 | 22.5 | 24.5 | 28.5 | 31.0 |
| REJECTION | | ○ | ○~△ | △ | × | × |

○ : REJECTION DID NOT OCCUR

△ : REJECTION OCCURRED BUT NOT THE ONE CAUSING PRACTICAL ISSUE

× : REJECTION OCCURRED

FIG.6

CONTACT ANGLE(° )

| | | EXAMPLE 4 | EXAMPLE 5 | EXAMPLE 6 | COMPARATIVE EXAMPLE 3 | COMPARATIVE EXAMPLE 4 |
|---|---|---|---|---|---|---|
| No. 1 | 1 | 9.0 | 13.0 | 18.5 | 19.5 | 22.0 |
| | 2 | 12.0 | 14.0 | 17.0 | 21.0 | 25.5 |
| | 3 | 11.0 | 14.5 | 17.5 | 21.5 | 25.0 |
| No. 2 | 1 | 12.5 | 13.5 | 15.0 | 21.5 | 23.5 |
| | 2 | 12.0 | 15.0 | 16.0 | 22.5 | 22.0 |
| | 3 | 12.0 | 14.0 | 16.5 | 22.5 | 23.5 |
| AVERAGE | | 11.4 | 14.0 | 16.8 | 21.4 | 23.6 |
| MAXIMUM VALUE | | 12.5 | 15.0 | 18.5 | 22.5 | 25.5 |
| SMALLEST VALUE | | 9.0 | 13.0 | 15.0 | 19.5 | 22.0 |
| REJECTION | | ○ | ○~△ | △ | × | × |

○ : REJECTION DID NOT OCCUR

△ : REJECTION OCCURRED BUT NOT THE ONE CAUSING PRACTICAL ISSUE

× : REJECTION OCCURRED

CAN BODY MANUFACTURING METHOD, PRINTING DEVICE, AND BEVERAGE CAN

TECHNICAL FIELD

The present invention relates to a can body manufacturing method, a printing device and a beverage can.

BACKGROUND ART

In Patent Document 1, there is disclosed an ultraviolet curable size coat ink including 30-95 mass % resin component and 5-50 mass % ultraviolet curable reactive diluent with a content of a color pigment component of 10 mass % or less and has a tack value of 5-40 at normal temperatures.

CITATION LIST

Patent Literature

Patent Document 1: Japanese Patent Application Laid-Open Publication No. 2003-12974

SUMMARY OF INVENTION

Technical Problem

In many cases the can bodies used for beverage cans are formed by metal, and when printing is performed on a can body formed by metal in such a manner, the metal base exerts an effect, to thereby decrease color saturation of a printed image. Here, in some cases, a base layer is formed on a circumferential surface of a can body to prevent decrease of the color saturation; however, if the base layer is simply formed, then, in turn, the metal base is hidden and it becomes impossible to provide a design that takes advantage of the metal base to the can body.

An object of the present invention is to increase a range of design variations provided to a can body on which a layer covering the metal base is formed.

SUMMARY OF INVENTION

A can body manufacturing method, the can body being used for a beverage can, to which the present invention is applied, includes: forming a layer on an outer circumferential surface of the can body which is formed cylindrically with a metal material and on the outer circumferential surface of which a metal base appears, the layer covering the metal base; and after forming the layer covering the metal base, forming an image on the outer circumferential surface of the can body, wherein formation of the layer covering the metal base is performed by an inkjet head having plural ink ejection ports and capable of controlling whether or not an ink is ejected for each of the plural ink ejection ports.

Here, the layer covering the metal base is formed on part of the outer circumferential surface of the can body, and the layer covering the metal base is formed to allow a portion where the layer covering the metal base is formed and a portion where the layer covering the metal base is not formed to be adjacent each other in a circumferential direction of the can body. In this case, it is possible to cause an image having luster and an image having lower luster level than this image to be adjacent each other in the circumferential direction of the can body, and thereby it is possible to increase a range of design variations provided to the can body.

Moreover, the layer covering the metal base is formed on part of the outer circumferential surface of the can body, and formation of the image is performed on both of a portion where the layer covering the metal base is formed and a portion where the layer covering the metal base is not formed. In this case, it becomes possible to form an image having luster and an image having lower luster level than this image onto a single can body, and thereby it is possible to increase a range of design variations provided to the can body.

Moreover, after the layer covering the metal base is formed, an ink of a color same as the layer covering the metal base is attached onto the layer covering the metal base, and the attachment of the ink is performed after at least a surface of the layer covering the metal base is cured. In this case, it is possible to prevent the size of the layer covering the metal base from becoming large as compared to the originally-intended size.

Moreover, in a case where the present invention is perceived as a printing device, the printing device to which the present invention is applied performs printing on a can body cylindrically formed with a metal material to be used for a beverage can, and the printing device includes: a layer forming unit that forms a layer on an outer circumferential surface of the can body by use of an inkjet head having plural ink ejection ports and capable of controlling whether or not an ink is ejected for each of the plural ink ejection ports, the layer covering a metal base appearing on the outer circumferential surface; and an image forming unit that forms an image on the outer circumferential surface of the can body after the layer is formed by the layer forming unit.

Here, the layer forming unit forms the layer covering the metal base by use of an ultraviolet curable ink. In this case, heating of ink is unnecessary, and therefore, energy consumption can be reduced.

Moreover, plural inkjet heads for forming the layer covering the metal base are provided. In this case, it is possible to make ink clogging of the inkjet heads less likely to occur as compared to a case where a single inkjet head is used.

Moreover, in a case where the present invention is perceived as a beverage can, the beverage can includes: a can main body portion cylindrically formed with a metal material; a layer formed on part of an outer circumferential surface of the can main body portion to cover a metal base appearing on the outer circumferential surface of the can main body portion; and an image layer formed on the outer circumferential surface of the can main body portion, wherein the layer covering the metal base is formed to allow a portion where the layer covering the metal base is formed and a portion where the layer covering the metal base is not formed to be adjacent each other in a circumferential direction of the can main body portion.

Advantageous Effects of Invention

According to the present invention, it is possible to increase a range of design variations provided to a can body on which a layer covering the metal base is formed.

BRIEF DESCRIPTION OF DRAWINGS

FIG. 5 is a diagram showing measurement results of contact angles; and

FIG. 6 is another diagram showing measurement results of the contact angles.

DESCRIPTION OF EMBODIMENTS

Hereinafter, an exemplary embodiment according to the present invention will be described in detail with reference to attached drawings.

Figure 1:
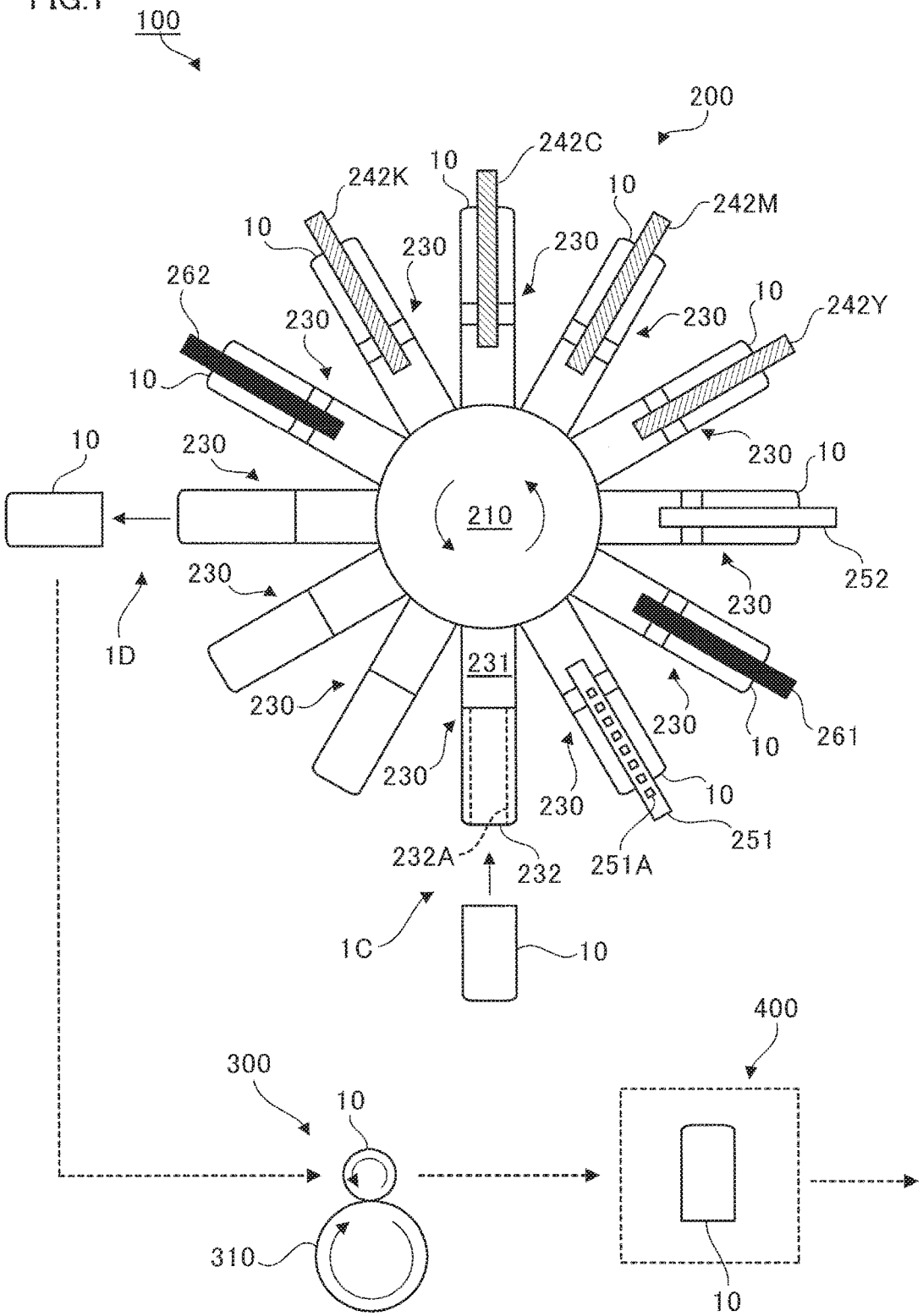
FIG. 1 is a diagram in a case where an image forming system related to an exemplary embodiment is viewed from above.

FIG. 1 is a diagram in a case where an image forming system 100 related to an exemplary embodiment is viewed from above.

The image forming system 100 in the exemplary embodiment forms an image onto a can body 10 used as a beverage can (a can for beverage) based on digital image information.

The image forming system 100 is provided with a printing device 200 that performs printing onto the can body 10 by use of an inkjet method. Moreover, there is also provided a paint coating device 300 that applies paint on the surface of the can body 10 to form an overcoat layer.

Note that, in the paint coating device 300, an outer circumferential surface of a coating roller 310 to be rotated is brought into contact with an outer circumferential surface of the can body 10 that is similarly rotated, to thereby perform coating of paint onto the can body 10. Here, in the exemplary embodiment, coating of the paint onto the can body 10 prevents an image formed with an ultraviolet curable ink (to be described later) from directly touching a mouth of a drinker of a beverage. Moreover, in the exemplary embodiment, coating of the paint protects the image formed on the surface of the can body 10 and makes the image less likely to be peeled off the can body 10.

Further, in the exemplary embodiment, a heating device 400, which heats the can body 10 and bakes the paint coated on the can body 10, is provided on a downstream side of the paint coating device 300.

Note that, in FIG. 1, the printing device 200 is shown in a state being viewed from above. Moreover, the paint coating device 300 and the heating device 400 are shown in a state being viewed from a lateral side.

The printing device 200 receives the can body 10 conveyed from an upstream side at a predetermined receiving position (a position indicated by the reference sign 1C in the figure, hereinafter, referred to as "can body receiving position 1C" in some cases). Moreover, the printing device 200 discharges the can body 10 on which the image has been formed at a predetermined discharging position (a position indicated by the reference sign 1D in the figure, hereinafter, referred to as "can body discharging position 1D" in some cases). Then, the can body 10 discharged at the can body discharging position 1D is conveyed toward the paint coating device 300.

Moreover, the printing device 200 is provided with a rotating member 210 that is formed in a cylindrical-columnar shape and is driven by a not-shown motor to be rotated in a direction of an arrow shown in the figure.

In addition, the printing device 200 is provided with plural holding mechanisms 230 that are provided to be protruded from an outer circumferential surface of the rotating member 210 while being shifted from one another in a rotating direction of the rotating member 210 and to receive the can bodies 10 received at the can body receiving position 1C and hold thereof. To additionally describe, the printing device 200 is provided with the plural holding mechanisms 230 that are arranged radially around the rotating member 210 to hold the can bodies 10 conveyed from the upstream side.

Moreover, the printing device 200 is provided with a first inkjet head for white color 251 (hereinafter, referred to as "first white head 251") functioning as a layer forming unit that ejects an ink of the ultraviolet curable type and of white color onto the outer circumferential surface of the can body 10 held by the holding mechanism 230 to form a white layer on the outer circumferential surface of the can body 10.

Further, in the rotating direction of the rotating member 210, a first irradiation lamp 261, which irradiates the outer circumferential surface of the can body 10 held by the holding mechanism 230 with ultraviolet rays, to thereby cure the white layer formed by the first white head 251, is placed on the downstream side of the first white head 251. Note that the first irradiation lamp 261 is configured with plural LEDs (Light Emitting Diodes).

Further, on the downstream side of the first irradiation lamp 261, a second inkjet head for white color 252 (hereinafter, referred to as "second white head 252") is provided. The second white head 252 makes an ink of the ultraviolet curable type and of white color adhere onto the white layer formed by the first white head 251 to increase the thickness of the white layer.

Moreover, on the downstream side of the second white head 252, inkjet heads for four colors 242Y, 242M, 242C and 242K that form images of yellow (Y), magenta (M), cyan (C) and black (K) (hereinafter, referred to as "color heads") are provided. Here, the four color heads 242Y, 242M, 242C and 242K functioning as an image forming unit performs image formation on the can body 10 by use of the ultraviolet curable ink.

Note that, in the exemplary embodiment, the inkjet heads are provided in the order of yellow (Y), magenta (M), cyan (C) and black (K); however, the order is merely an example and the inkjet heads may be arranged in other orders.

Moreover, in the printing device 200 of the exemplary embodiment, a second irradiation lamp 262 is provided on the downstream side of the four color heads 242Y, 242M, 242C and 242K. The second irradiation lamp 262 irradiates the outer circumferential surface of the can body 10 with the ultraviolet rays, to thereby cure the white ink supplied from the second white head 252 to the can body 10 and the image (ink) formed on the can body 10 by the color heads 242Y, 242M, 242C and 242K. Note that, similar to the first irradiation lamp 261, the second irradiation lamp 262 is configured with plural LEDs (Light Emitting Diodes).

In the exemplary embodiment, in this manner, curing of the white ink supplied to the can body 10 from the second white head 252 and the image formed by the four color heads 242Y, 242M, 242C and 242K is performed by use of the second irradiation lamp 262. Incidentally, this mode is merely an example, and the irradiation lamp may be provided on the downstream side of the second white head 252 and on the upstream side of the color heads 242Y, 242M, 242C and 242K. In this case, before performing image formation by the color heads 242Y, 242M, 242C and 242K, curing of the white ink supplied by the second white head 252 is carried out.

Moreover, for example, it may be possible to provide irradiation lamps between the color heads 242Y, 242M, 242C and 242K to perform irradiation of ultraviolet rays every time each of the color heads 242Y, 242M, 242C and 242K performs image formation onto the can body 10.

Here, for the first white head 251, the second white head 252 and the color heads 242Y, 242M, 242C and 242K, those belonging to a category referred to as an on-demand type can be adopted. Specifically, a piezo system that ejects ink from a minute hole by a pressure generated by deforming a piezoelectric element or a thermal system that ejects ink from a minute hole by a vapor pressure can be adopted. It is possible to adopt another system belonging to a category referred to as a continuous type, which ejects ink by an electrical force or the like.

Next, to describe the holding mechanism 230, the holding mechanisms 230 is provided with a securing member 231 that is protruded from the outer circumferential surface of the rotating member 210 and arranged substantially horizontally to be secured to the rotating member 210. Further, a support cylinder (mandrel) 232, which is formed into a cylindrical shape and inserted into the can body 10 to support the can body 10, is provided. Note that, a through hole 232A along the axial direction of the support cylinder 232 is formed in the support cylinder 232, and in the exemplary embodiment, attachment or detachment of the can body 10 to or from the support cylinder 232 is carried out by creating a negative pressure or applying a pressure within the through hole 232A.

Further, in the exemplary embodiment, inside the securing member 231, there is provided a rotating mechanism (not shown) that includes a motor or the like to rotate the support cylinder 232 in the circumferential direction. Moreover, in the exemplary embodiment, a grasp mechanism (not shown) that grasps the status (the phase and the rotating angle from the reference position) of the support cylinder 232 is provided. The grasp mechanism is configured with, for example, a rotary encoder. Here, in the exemplary embodiment, based on a grasping result from the grasp mechanism, the ejection starting timing of the ink in each of the second white head 252 and the color heads 242Y, 242M, 242C and 242K is controlled. This suppresses occurrence of displacement in the image formed on the can body 10.

Operations of the printing device 200 will be described.

The printing device 200, first, receives the can body 10 conveyed from the upstream side at the can body receiving position 1C. Specifically, the can body 10 is conveyed to the can body receiving position 1C by a not-shown can body conveyance mechanism, and the support cylinder 232 is placed on standby at the can body receiving position 1C. Then, suction of the can body 10 by the support cylinder 232 is carried out. Specifically, the negative pressure is created in the through hole 232A formed in the support cylinder 232, and thereby suction of the can body 10 is carried out. This allows the support cylinder 232 to enter into the can body 10, and the support cylinder 232 starts to hold the can body 10.

Note that the can body 10 in the exemplary embodiment is formed into a cylindrical shape. Moreover, the can body 10 is formed of a metal material. Specifically, the can body 10 is formed of aluminum or an aluminum alloy. Moreover, the can body 10 is formed by the Draw and Ironing (DI) molding, and a barrel portion and a bottom portion are integrated. Moreover, in the can body 10, a bottom portion is formed at one end portion in the longitudinal direction (axial direction), and the one end portion is in a closed state. On the other hand, the other end portion of the can body 10 is not closed and in an opened state. The support of the can body 10 by the support cylinder 232 is carried out by insertion of the support cylinder 232 into the inside of the can body 10 from the opened side.

After support of the can body 10 by the support cylinder 232 is performed, rotation of the rotating member 210 is carried out. This causes the can body 10 to move toward the counterclockwise direction in FIG. 1. To additionally describe, by performing rotation of the rotating member 210, the movement of the support cylinder 232 is carried out, and the can body 10 is moved in the counterclockwise direction in the figure along with the movement of the support cylinder 232.

Moreover, in the exemplary embodiment, after support of the can body 10 by the support cylinder 232 is performed, rotation of the support cylinder 232 is started, and thereby rotation of the can body 10 in the circumferential direction is started (rotation of the can body 10). Note that, in the exemplary embodiment, in a region positioned between the can body receiving position 1C and the first white head 251, acceleration (increase of the number of revolutions) of the support cylinder 232 is performed, and the number of revolutions of the support cylinder 232 reaches a predetermined number of revolutions until the can body 10 arrives at the first white head 251.

When the can body 10 arrives at the first white head 251, rotation of the rotating member 210 is temporarily stopped. Subsequently, from the first white head 251, the white ink is ejected toward the can body 10 that is positioned below and rotates at a predetermined speed, and thereby a white layer is formed onto the outer circumferential surface of the can body 10. Thereafter, in the exemplary embodiment, rotation of the rotating member 210 is restarted, and the can body 10 reaches below the first irradiation lamp 261. Accordingly, the outer circumferential surface of the can body 10 is irradiated with the ultraviolet rays, and thereby the white layer formed by the first white head 251 is cured.

Note that, in the exemplary embodiment, rotation of the rotating member 210 is once stopped every time the can body 10 arrives at each of the inkjet heads and each of the irradiation lamps, and ejection of ink onto the can body 10 or irradiation of the can body 10 with the ultraviolet rays are finished, rotation of the rotating member 210 is restarted.

Moreover, in the exemplary embodiment, ink is ejected from above the can body 10 toward the can body 10. In this case, the acting direction of gravity and the ejecting direction of ink coincide with each other, and accordingly, behavior of the ejected ink becomes stable, and it becomes possible to control an arrival position of ink with more accuracy.

Note that, when the can body 10 is successively moved to the inkjet head positioned on the downstream side, rotation of the support cylinder 232 may be once stopped, or the number of revolutions of the support cylinder 232 may be reduced. Moreover, the can body 10 may be moved while the support cylinder 232 is still rotated (while the number of revolutions of the support cylinder 232 is maintained).

After irradiation of the ultraviolet rays by the first irradiation lamp 261 is finished, in the exemplary embodiment, the can body 10 is once stopped below the second white head 252, and white ink is ejected from the second white head 252 toward the outer circumferential surface of the can body 10. To additionally describe, in the exemplary embodiment, to the white layer formed on the outer circumferential surface of the can body 10 by the first white head 251, the white ink is supplied again. This increases the thickness of the white layer as compared to a case in which the white layer is formed only by the first white head 251.

Thereafter, in the exemplary embodiment, the can body 10 is once stopped below each of the color heads constituting the four color heads 242Y, 242M, 242C and 242K, and image formation onto the can body 10 is carried out. Consequently, on the can body 10, an image using the ink of at least any one of yellow (Y), magenta (M), cyan (C) and black (K) is formed. Thereafter, the can body 10 is moved below the second irradiation lamp 262, and the outer circumferential surface of the can body 10 is irradiated with the ultraviolet rays. Accordingly, the white ink supplied from the second white head 252 and the color ink supplied from the color heads 242Y, 242M, 242C and 242K are cured.

Thereafter, further rotation of the rotating member 210 is carried out, and thereby the can body 10 arrives at the can body discharge position 1D. Then, at the can body discharge position 1D, air blowing into the through hole 232A formed in the support cylinder 232 is performed. This increases the pressure inside the through hole 232A, and accordingly, the can body 10 is moved in a direction apart from the support cylinder 232. By the movement of the can body 10, the can body 10 is disconnected from the support cylinder 232.

Note that, in the exemplary embodiment, a single-color ink is ejected from each of the first white head 251 and the second white head 252, and each of the color heads 242Y, 242M, 242C and 242K provided to the printing device 200. Accordingly, image formation onto the can body 10 is carried out by overprinting using plural inkjet heads. In this case, registration of ejection positions of ink is required, and in the exemplary embodiment, the registration is performed by the following process.

First, in the exemplary embodiment, when ejection of ink by the first white head 251 is started, an output from a rotary encoder is grasped by a not-shown controller, and accordingly, a rotation angle of the can body 10 when ink ejection by the first white head 251 is started is grasped. Note that, in this specification, hereinafter, the grasped rotation angle is referred to as "reference angle".

Thereafter, in the exemplary embodiment, the can body 10 arrives at the second white head 252 and ejection of ink by the second white head 252 is started; at this time, an output from the rotary encoder is grasped, and thereby the rotation angle of the can body 10 is also grasped. After that, the controller subtracts the above-described reference angle from the grasped rotation angle (hereinafter, referred to as "grasped angle"), to thereby obtain an angle difference.

Thereafter, the controller starts reading, of the image data stored in a not-shown page memory, from the image data corresponding to the angle difference, and sequentially supplies the read image data to the second white head 252. Consequently, in the exemplary embodiment, occurrence of misregistration between the white layer formed by the first white head 251 and the white layer formed by the second white head 252 is suppressed.

Note that, as the same is true for the case in which an image is formed by the color heads 242Y, 242M, 242C and 242K, every time the can body 10 arrives at each of the color heads 242Y, 242M, 242C and 242K, the reference angle is subtracted from the grasped angle, to thereby obtain the angle difference. Then, the image data is supplied to each of the color heads successively from image data corresponding to the angle difference.

Note that the registration of images may be carried out by, for example, every time the can body 10 arrives at each of the inkjet heads, once arranging the can body 10 to have the above-described reference angle, and then, of the image data, successively supplying the image data corresponding to the reference angle to the inkjet head.

FIGS. 2A to 2E are diagrams showing an example of a process carried out by the image forming system 100.

Figures 2A, 2B, 2C, 2D, 2E:
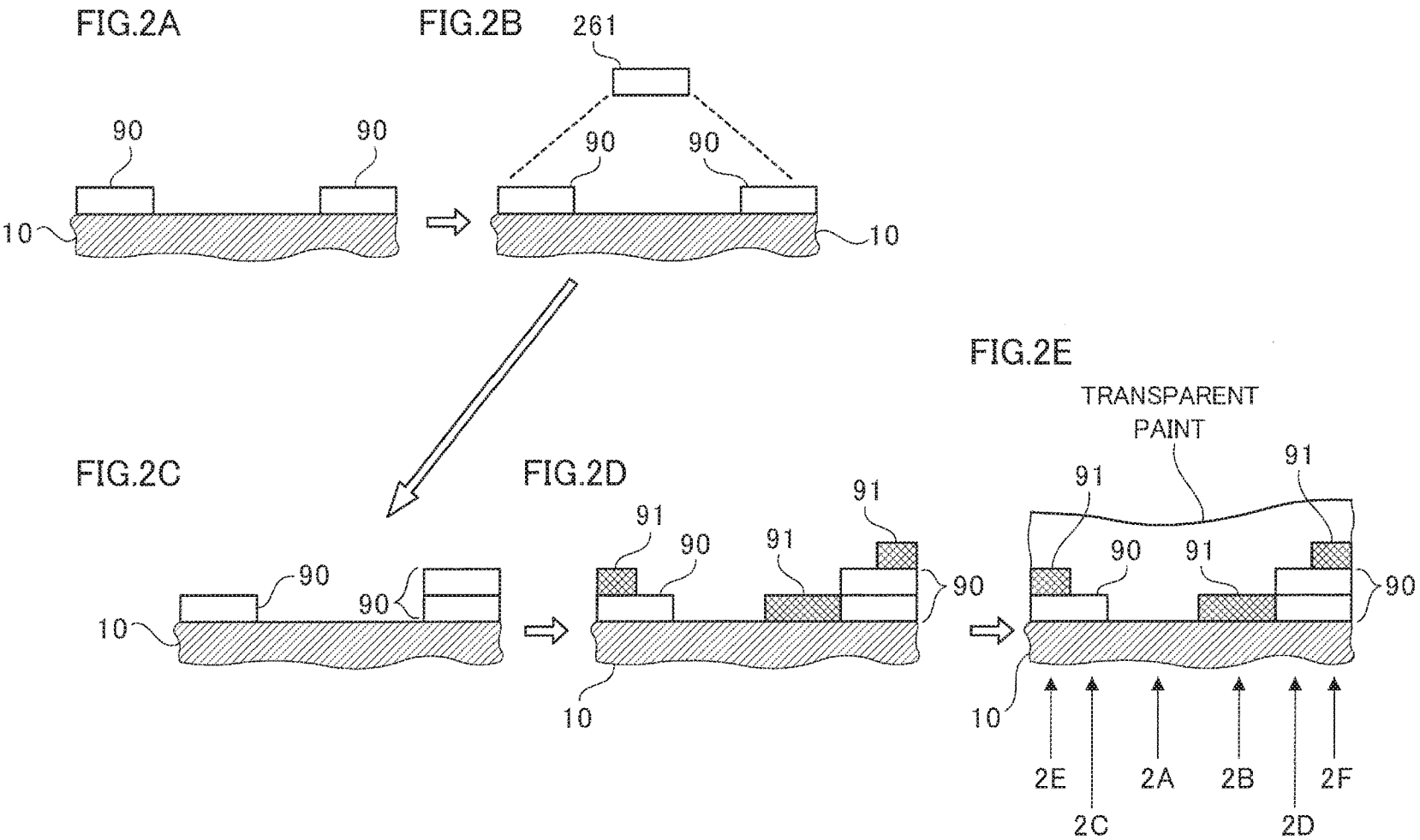
FIGS. 2A to 2E are diagrams showing an example of a process carried out by the image forming system.

In the exemplary embodiment, as described above, or as shown in FIG. 2A, first, the white layers 90 are formed on the surface of the can body 10 (can main body) by the first white head 251. Next, as shown in FIG. 2B, irradiation of ultraviolet rays by the first irradiation lamp 261 is performed and the white layers 90 are cured. Then, the can body 10 arrives at the second white head 252 and, as shown in FIG. 2C, more white ink is placed on part of the white layers 90 formed by the first white head 251. As a result, the thickness of part of the white layers 90 is increased.

Next, the can body 10 successively passes below the color heads 242Y, 242M, 242C and 242K. As a result, as shown in FIG. 2D, color ink is placed on the surface of the can body 10 (on the metal base) and the white layers 90, to thereby form color ink layers 91 as an example of an image layer. Thereafter, coating of a paint is performed by the paint coating device 300 (refer to FIG. 1), and as shown in FIG. 2E, a transparent paint is applied to the uppermost surface of the can body 10. After that, heating by the heating device 400 (refer to FIG. 1) is performed, and thereby the paint is cured.

Here, with reference to FIG. 2E, the status of the surface of the can body 10 will be described in detail. In the printing device 200 of the exemplary embodiment, 6 types of layer configurations (tones) can be obtained. Specifically, the layer configurations of the following (1) to (6) can be obtained.

Layer configuration (1): only aluminum base (only metal base)

Layer configuration (2): aluminum base+color ink layer 91

Layer configuration (3): aluminum base+single white layer 90

Layer configuration (4): aluminum base+double white layers 90

Layer configuration (5): aluminum base+single white layer 90+color ink layer 91

Layer configuration (6): aluminum base+double white layers 90+color ink layer 91

Here, in FIG. 2E, the above-described layer configuration (1) is formed in the portion indicated by the reference sign 2A. Moreover, the layer configuration (2) is formed in the portion indicated by the reference sign 2B. Further, the layer configuration (3) is formed in the portion indicated by the reference sign 2C. Moreover, the layer configuration (4) is formed in the portion indicated by the reference sign 2D. Moreover, the layer configuration (5) is formed in the portion indicated by the reference sign 2E. Further, the layer configuration (6) is formed in the portion indicated by the reference sign 2F.

In the layer configuration (1) (the portion indicated by the reference sign 2A), the metal base of the can body 10 is in a visible state, and accordingly, in the portion of the layer configuration (1), an outer appearance thereof has a state having a metallic luster (metallic tone). To additionally describe, the outer appearance is silver and has a state having a luster. Moreover, in the layer configuration (2) (the portion indicated by the reference sign 2B), the metal base of the can body 10 is in a state being colored, and accordingly, the portion of the layer configuration (2) has a state having color and a metallic luster (colored metallic tone).

Moreover, in the layer configuration (3) (the portion indicated by the reference sign 2C), the metal base of the can body 10 is in the state being covered with the white layer, and the luster arising from the metal base of the can body 10 is reduced. Moreover, in the layer configuration (4) (the portion indicated by the reference sign 2D), the thickness of the white layers 90 is larger than that of the layer configuration (3), and accordingly, the luster is further reduced as compared to the portion of the layer configuration (3). Here, in the case where two layer configurations, in which the thickness of the white layers 90 is different, are provided in this manner, it becomes possible to form two regions having the same white color but differing concentrations.

Moreover, in the layer configuration (5) (the portion indicated by the reference sign 2E), the color ink layer 91 is formed, and accordingly, the portion is formed in a state having colors. Note that, in the layer configuration (5), since the white layer 90 to cover the metal base of the can body 10 is formed under the color ink layer 91, colors are vividly produced. Moreover, in the layer configuration (6) (the portion indicated by the reference sign 2F), the color ink layer 91 is also formed, and accordingly, the portion is formed in a state having colors. Note that, in the layer configuration (6), the white layers 90 include two layers, and therefore, colors are more vivid than in the layer configuration (5).

Note that, in the exemplary embodiment, the metal base of the can body 10 is covered with the white ink; however, the color of ink to cover the metal base of the can body 10 is not limited to white, and ink of a different color may be used.

Moreover, it is unnecessary to equalize the amount of ink ejected from the first white head 251 per unit time and the amount of ink ejected from the second white head 252 per unit time, and the amount of ink ejected from the first white head 251 per unit time and the amount of ink ejected from the second white head 252 per unit time may be different. For example, if the second white head 252 is provided in an auxiliary manner, it is possible to reduce the amount of ink ejected from the second white head 252 as compared to the amount of ink ejected from the first white head 251.

Figure 3B:
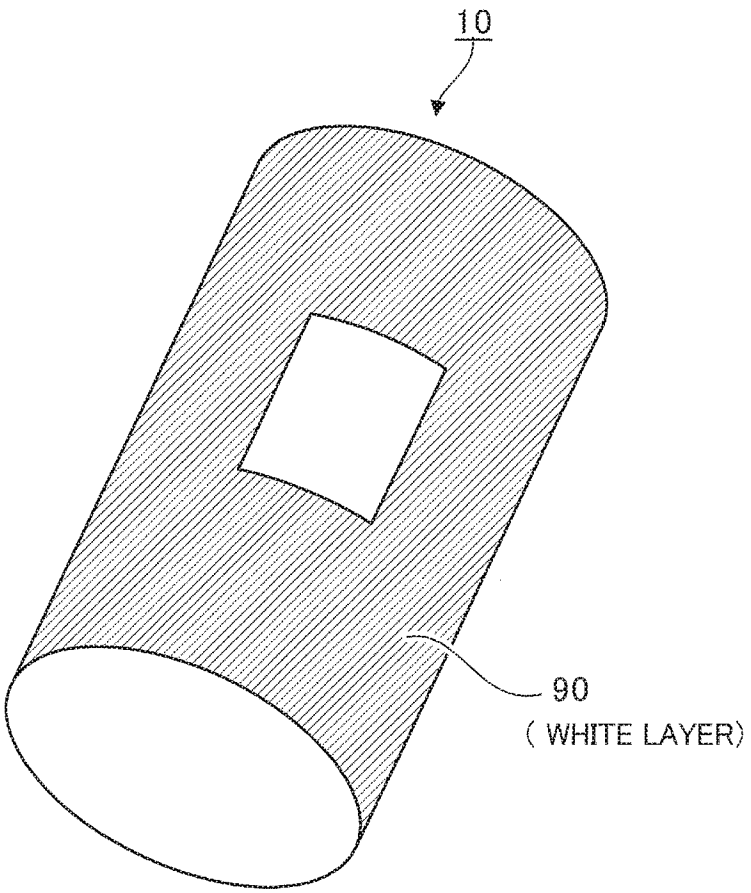
FIGS. 3A and 3B are diagrams showing white layers formed by a printing device of the exemplary embodiment.
Figure 3A:
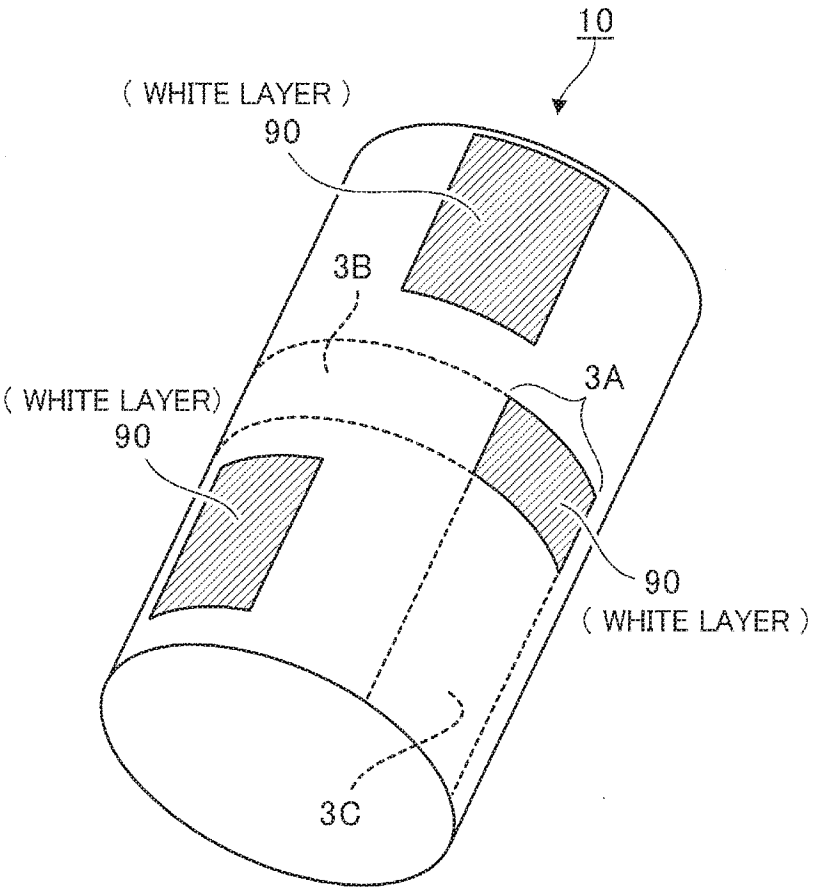
Figure 4:
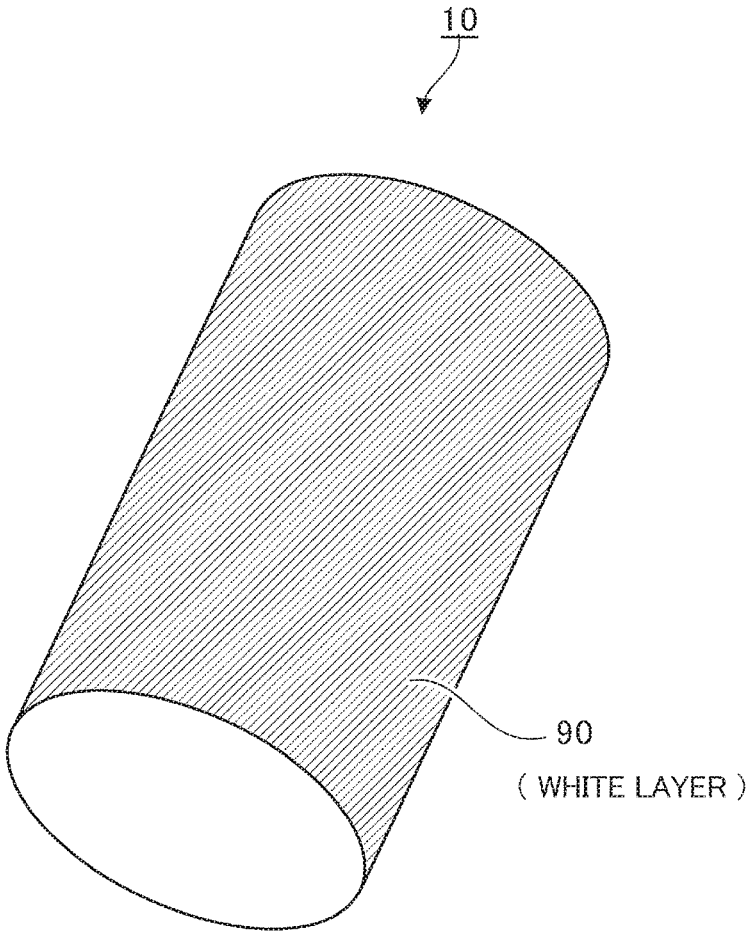
FIG. 4 is a diagram showing a white layer formed by a conventional printing device.

FIGS. 3A and 3B are diagrams showing the white layers 90 formed by the printing device 200 of the exemplary embodiment. FIG. 4 is a diagram showing a white layer 90 formed by a conventional printing device.

In the exemplary embodiment, as described above, the first white head 251 and the second white head 252 are configured with inkjet heads. Here, the first white head 251 and the second white head 252 will be described in detail by taking the first white head 251 as an example.

The first white head 251 is, as shown in FIG. 1, arranged along the axial direction of the cylindrical can body 10. Further, the first white head 251 is provided with plural ink ejection ports 251A arranged in the axial direction of the can body 10. Further, in the first white head 251, it is possible to control whether or not ejection of ink is performed for each of the ink ejection ports 251A.

Consequently, in the exemplary embodiment, it becomes possible to form the white layer 90 at arbitrary portions of the can body 10. For example, as shown in FIG. 3A, it is possible to form plural white layers 90 in the island states. Moreover, for example, as shown in FIG. 3B, it becomes possible to form the white layer 90 on all the portions of the outer circumferential surface of the can body 10 except for a specific region.

On the other hand, in the conventional process, in general, ink is adhered to an outer circumferential surface of a roll-like member, and the outer circumferential surface is brought into contact with the outer circumferential surface of the can body 10. In this case, as shown in FIG. 4, the white layer 90 is formed over the entire circumference of the can body 10.

To describe further, in the exemplary embodiment, it is possible to form the white layer 90 at any position in the circumferential direction and the axial direction of the can body 10.

Consequently, in the exemplary embodiment, for example, the white layer 90 and the portion where the white layer 90 is not formed and the metal base of the can body 10 appears can be adjacent each other in the circumferential direction of the can body 10. To specifically describe with reference to FIG. 3A, for example, the white layer 90 indicated by the reference sign 3A and the portion where the metal base appears indicated by the reference sign 3B can be adjacent each other in the circumferential direction of the can body 10.

Moreover, in a similar manner, the white layer 90 and the portion where the white layer 90 is not formed and the metal base of the can body 10 appears can be adjacent each other in the axial direction of the can body 10. To specifically describe with reference to FIG. 3A, the white layer 90 indicated by the reference sign 3A and the portion where the metal base appears indicated by the reference sign 3C can be adjacent each other in the axial direction of the can body 10.

To describe further, in the case where the conventional process is performed, as described above, the white layer 90 is formed over the entire circumference of the can body 10, and therefore, it becomes difficult to allow the layer configuration in which the color ink is directly placed on the metal base and the layer configuration in which the color ink is placed with the white layer interposed to coexist.

On the other hand, in the exemplary embodiment, the white layer 90 can be formed on a part of the outer circumferential surface of the can body 10, and therefore, it becomes possible to allow the layer configuration in which the color ink is directly placed on the metal base and the layer configuration in which the color ink is placed with the white layer interposed to coexist. In this case, as compared to the case where the above-described conventional process is performed, it becomes possible to increase the range of design variations of the can body 10.

To additionally describe, in the process of the exemplary embodiment, for example, even in the case where an image of the same color is to be formed, it is possible to form two types of images, namely, an image having luster (a metal tone image) and an image having no luster (an image of excellent color production) onto a single can body 10.

Moreover, in the process of the exemplary embodiment, as compared to the above-described conventional process, energy consumption can be reduced. In the conventional process, the white layer 90 is formed by using an ink of thermal cure type in many cases, and in this case, a process for heating the can body 10 is required. On the other hand, in the process of the exemplary embodiment, the white layer 90 is cured by irradiation of the ultraviolet rays. Accordingly, in the exemplary embodiment, the heating process is unnecessary, and therefore the consumption energy is reduced. Moreover, in the conventional process, a heating device is needed to heat the can body 10; however, in the exemplary embodiment, the heating device can be omitted. As a result, in the exemplary embodiment, an occupancy area of the device is reduced as compared to the conventional process.

Further, in the process of the exemplary embodiment, it is possible to increase accuracy of registration between the white layers 90 and the color ink layers 91. In the exemplary embodiment, the white layers 90 and the color ink layers 91 are formed while the can body 10 is conveyed in a single device (in the single printing device 200). To additionally describe, in a single continuous process, the white layers 90 and the color ink layers 91 are formed. In such a case, it becomes possible to suppress displacement of the can body 10, and therefore, it becomes possible to increase accuracy of registration between the white layers 90 and the color ink layers 91.

To describe further, in the exemplary embodiment, the support cylinder 232 (refer to FIG. 1) that supports the can body 10 when the white layers 90 are formed and the support cylinder 232 that supports the can body 10 when the color ink layers 91 are formed are the same. In such a case, displacement of the can body 10 is suppressed, and therefore, it is possible to carry out registration between the white layers 90 and the color ink layers 91 accurately. Here, in a case where the support cylinder 232 that supports the can body 10 when the white layers 90 are formed and the support cylinder 232 that supports the can body 10 when the color ink layers 91 are formed are different, accuracy of registration between the white layers 90 and the color ink layers 91 is likely to be decreased.

Moreover, in the exemplary embodiment, as described above, after the layers of the white ink formed by the first white head 251 are cured by the first irradiation lamp 261, supply of the white ink by the second white head 252 is performed. To additionally describe, after the layers of the white ink formed by the first white head 251 are cured by the first irradiation lamp 261, the white ink, which is the same color, is further adhered onto the layers of the white ink. This suppresses occurrence of bleeding in the white layers 90 to be formed. To additionally describe, bleeding of the white ink beyond the originally-intended outline is suppressed.

Here, if the white ink is supplied from the second white head 252 before the white ink layers formed by the first white head 251 are cured, the ink is likely to flow off in the outward direction. In such a case, the white layers 90 are formed into a size larger than the intended size. On the other hand, as in the exemplary embodiment, in the case where the white ink layers formed by the first white head 251 are cured before the white ink is supplied by the second white head 252, flow off of the ink to the outside is less likely to occur, and accordingly, the size of the white layers 90 is prevented from becoming larger than the originally-intended size. Note that, in curing the white ink layers, it is sufficient that the surfaces of the ink layers are cured, and it is unnecessary to cure all of the ink layers.

Moreover, in the exemplary embodiment, as described above, by use of two inkjet heads, namely, the first white head 251 and the second white head 252, the thickness of the white layers 90 is increased. Further, in the exemplary embodiment, by use of two inkjet heads, namely, the first white head 251 and the second white head 252, clogging of the inkjet heads is less likely to occur. Here, for example, even in a case where only one white head is provided, by increasing concentration or the like of pigments contained in the ink, it is possible to obtain blocking capability which is same as in the case of increasing the thickness of the white layers 90.

By the way, if the concentration of the pigment is increased in this manner, clogging of the inkjet heads is apt to occur. On the other hand, in the case where the two inkjet heads are provided as in the exemplary embodiment, as compared to the case where the only one inkjet head is provided, it is possible to reduce concentration of the pigments, and accordingly, clogging of the inkjet heads is less likely to occur. Note that, even in the case where the only one inkjet head is used, by two rotations of the can body 10, it is possible to increase the thickness of the white layers 90 while suppressing clogging of the head; however, in this case, bleeding as described above (flow of the ink to the outward direction) is likely to occur.

Note that, as shown in FIG. 1, in the exemplary embodiment, the first irradiation lamp 261 is placed on the downstream side of the first white head 251, and when irradiation of the ultraviolet rays by the first irradiation lamp 261 is performed, the can body 10 is moved from the first white head 251 to the first irradiation lamp 261. The placement position of the first irradiation lamp 261 is not limited to the position shown in FIG. 1; for example, the first irradiation lamp 261 may be provided beside the first white head 251 and on the downstream side of the first white head 251 in the rotation direction of the support cylinder 232. In this case, irradiation of the ultraviolet rays is performed immediately after the white layers 90 are formed by the first white head 251, and the white layers 90 are cured. To additionally describe, in this case, irradiation of the can body 10 with the ultraviolet rays without moving the can body 10 to the downstream side.

Moreover, in the exemplary embodiment, as shown in FIG. 1, description has been given of a mode in which the first white head 251, the first irradiation lamp 261, the second white head 252, the color heads 242Y, 242M, 242C and 242K and the second irradiation lamp 262 have been radially arranged around the rotating member 210. By the way, the arrangement mode of these heads is not particularly limited; each head may be arranged so that, for example, each of the heads are in parallel with one another and aligned along one direction. In this case, in the course of linearly moving the can body 10, image formation or the like onto the can body 10 is performed.

Moreover, in the above, description has been given of the case in which one color head has been provided for each of the colors. Specifically, in the exemplary embodiment, the color heads 242Y, 242M, 242C and 242K for forming images of yellow (Y), magenta (M), cyan (C) and black (K), respectively, are provided, and a single color head is provided for one color. Incidentally, this mode is merely an example, and two or more color heads may be provided for one color. Moreover, two or more color heads may be provided for each of yellow (Y), magenta (M), cyan (C) and black (K), or, two or more color heads may be provided only for a specific color. In the case where two or more heads are provided in this way, for example, it becomes possible to recoat with ink of the same color, and to thicken the color of the recoated portion (color production is further improved).

Moreover, in the exemplary embodiment, as described above, after the layers of the white ink formed by the first white head 251 are cured by the first irradiation lamp 261, the white ink is supplied onto this layer (hereinafter, referred to as "white cured layer") by the second white head 252. In the case of performing such a process, it is preferable to make the surface tension of the white ink supplied from the second white head 252 smaller than the surface tension of the white cured layer.

In the case where the white ink is further supplied onto the white cured layer, there is a possibility that the supplied white ink is rejected and the white ink is less likely to be placed on the white cured layer. If the surface tension is decreased as described above, the white ink supplied from the second white head 252 is likely to be placed on the white cured layer.

Moreover, it is preferable to set the surface tension of the white ink such that the contact angle of the white ink when the white ink is placed on the white cured layer by the second white head 252 becomes not more than a certain value. Here, if the contact angle becomes large, the white ink supplied from the second white head 252 is likely to be rejected.

Here, the inventors made an investigation (experiment 1) about relation between the contact angle of the white ink supplied onto the white cured layer and a level of rejection, and found that the ink rejection was suppressed in the case where the contact angle was not more than a certain value. Moreover, for confirmation, an investigation (experiment 2) was made about the contact angle of a black ink supplied onto a later-described washed can and the level of rejection.

Hereinafter, conditions of experiments and results of experiments will be described.

Conditions of Experiment 1

(A) After supplying the white ink onto the white cured layer, the white ink was irradiated with the ultraviolet rays to cure the white ink. Thereafter, status of the white ink after curing was confirmed by visual inspection, to confirm whether the rejection occurred.

(B) Moreover, before the above-described curing by the ultraviolet rays was performed, the contact angle of the white ink placed on the white cured layer was measured. Note that the measuring tool and the measuring method of the contact angle are as follows:

Measuring instrument . . . CA-A contact angle meter manufactured by Kyowa Interface Science Co., LTD.

Measuring method . . . A droplet having the diameter of about 1.5 mm is prepared at a tip end a needle of a supplied droplets regulator (injection cylinder). Then, the droplet is transferred to the surface of a sample (surface of the white cured layer), and the contact angle of the droplet is measured.

(C) Moreover, 5 conditions of white ink (Examples 1 to 3, Comparative examples 1 and 2) were prepared, the contact angle of each of 5 conditions of white ink was measured, and further, the level of rejection was confirmed. Moreover, each of 5 conditions of the white ink, experiment was carried out twice (N=2). Moreover, measurement of the contact angle of the droplet was carried out at 3 locations (droplets were attached to 3 locations), and an average of three measured values was regarded as a measurement result. In other words, 6 droplets were prepared for each of 5 conditions of the white ink, and the contact angle was measured for each of the 6 droplets (the contact angles of 30 droplets in total were measured).

Conditions of Experiment 2

(A) An edge of an opening portion of a can body having been DI-molded as conventional manner was trimmed, and a washed can was prepared by a conventional washing process (hot-water washing, degreasing process, water washing, chemical conversion coating process, water washing, pure-water washing and drying). Similar to (A) in conditions of experiment 1, after supplying black ink onto the above-described washed can, the black ink was irradiated with the ultraviolet rays to cure the black ink. Thereafter, status of the black ink after curing was confirmed by visual inspection, to confirm whether the rejection occurred. To additionally describe, in the experiment using the black ink, the black ink was not supplied onto the white cured layer, but was supplied onto the can body directly. Then, the black ink was irradiated with the ultraviolet rays to be cured, the status of the black ink after curing was confirmed by visual inspection, and further, whether the rejection occurred was confirmed.

(B) Moreover, before the above-described curing by the ultraviolet rays was performed, the contact angle of the black ink placed on the washed can was measured. Note that the measuring tool and the measuring method of the contact angle are similar to (B) in conditions of experiment 1.

(C) Moreover, 5 conditions of washed can (Examples 4 to 6, Comparative examples 3 and 4) were prepared, the contact angle of each of 5 conditions of washed can was measured, and further, the level of rejection was confirmed. The number of measurement is same as (C) in conditions of experiment 1.

Results of Experiments

The results of experiment 1 are shown in FIG. 5. Moreover, the results of experiment 2 are shown in FIG. 6.

Here, in Example 1 of FIG. 5, the maximum value of the contact angle was 22.0°, and in this case, rejection of the white ink did not occur. Moreover, in Example 2, the maximum value of the contact angle was 25.0°, and in this case, of the 6 droplets, rejection did not occur in some droplets, but rejection occurred in some other droplets. However, the rejection was not the one causing the practical issue. Further, in Example 3, the maximum value of the contact angle was 28.0°, and rejection occurred in this case; however, the rejection was not the one causing the practical issue.

On the other hand, as in Comparative examples 1 and 2, if the contact angle exceeded 28°, rejection began to occur.

Moreover, in Example 4 of FIG. 6, the maximum value of the contact angle was 12.5°, and in this case, rejection of the black ink did not occur. Moreover, in Example 5, the maximum value of the contact angle was 15.0°, and in this case, of the 6 droplets, rejection did not occur in some droplets, but rejection occurred in some other droplets. However, the rejection was not the one causing the practical issue. Further, in Example 6, the maximum value of the contact angle was 18.5°, and rejection occurred in this case; however, the rejection was not the one causing the practical issue.

On the other hand, as in Comparative examples 3 and 4, if the contact angle exceeded 19°, rejection began to occur. Moreover, these results were substantially the same as values in the ink of other colors.

In consideration of the above results, in the case where the white ink is supplied onto the white cured layer, rejection can be suppressed if the contact angle is not more than 28°. Note that, the contact angle is preferably not more than 25°, and more preferably not more than 22°. Moreover, it is preferable that the contact angle is close to 0°, and the lower limit value is 0°. Note that it is difficult to set the angle to 0° in practice; for example, as shown in Example 1 in FIG. 5, the smallest value of the contact angle (the lower limit value of the contact angle) is, for example, 17°.

In a similar manner, in the case where the black ink is supplied onto the washed can, rejection can be suppressed if the contact angle is not more than 19°. Note that, the contact angle is preferably not more than 15°, and more preferably not more than 13°. Moreover, it is preferable that the contact angle is close to 0°, and the lower limit value is 0°. Note that it is also difficult to set the angle to Win this case; for example, as shown in Example 4 in FIG. 6, the smallest value of the contact angle (the lower limit value of the contact angle) is, for example, 9°.

REFERENCE SIGNS LIST

10 Can body
90 White layer

91 Color ink layer
200 Printing device
242Y, 242M, 242C, 242K Color head
251 First white head
251A Ink ejection port
252 Second white head

The invention claimed is:

1. A can body manufacturing method, the can body being used for a beverage can, the can body manufacturing method comprising:

forming a first ink layer on an outer circumferential surface of the can body which is formed cylindrically with a metal material and on the outer circumferential surface of which a metal base appears, the first ink layer covering the metal base;

forming a second ink layer by attaching ink to a part of the first ink layer covering the metal base to increase a thickness of the part of the first ink layer covering the metal base; and after forming the first ink layer covering the metal base and the second ink layer on the first ink layer covering the metal base, forming an image on the outer circumferential surface of the can body, wherein the ink of the second ink layer formed on the part of the first ink layer covering the metal base has the same color as the layer covering the metal base, and the image is formed on both a portion of the outer circumferential surface of the can body where the thickness is increased by the second ink layer on the first ink layer covering the metal base and a portion of the outer circumferential surface of the can body where the thickness is not increased by the second ink layer on the first ink layer covering the metal base.

2. The can body manufacturing method according to claim 1, wherein the first ink layer covering the metal base is formed on part of the outer circumferential surface of the can body, and the first ink layer covering the metal base is formed to allow a portion where the first ink layer covering the metal base is formed and a portion where the first ink layer covering the metal base is not formed to be adjacent each other in a circumferential direction of the can body.

3. The can body manufacturing method according to claim 1, wherein the first ink layer covering the metal base is formed on part of the outer circumferential surface of the can body, and formation of the image is performed on both of a portion where the first ink layer covering the metal base is formed and a portion where the first ink layer covering the metal base is not formed.

4. The can body manufacturing method according to claim 1, wherein, the second ink layer is formed after at least a surface of the first ink layer covering the metal base is cured.

5. The can body manufacturing method according to claim 1, wherein formation of the first ink layer covering the metal base is performed by an inkjet head having a plurality of ink ejection ports and capable of controlling whether or not an ink is ejected for each of the plurality of ink ejection ports.

6. The can body manufacturing method according to claim 1, further comprising:

forming the image on a portion where the metal base appears.

7. A can body manufacturing method, the can body being used for a beverage can, the can body manufacturing method comprising:

forming a layer on an outer circumferential surface of the can body which is formed cylindrically with a metal material and on the outer circumferential surface of which a metal base appears, the layer covering the metal base; and after forming the layer covering the metal base, forming an image on the outer circumferential surface of the can body, wherein formation of the layer covering the metal base is performed by an inkjet head having a plurality of ink ejection ports and capable of controlling whether or not an ink is ejected for each of the plurality of ink ejection ports, the layer covering the metal base is formed on part of the outer circumferential surface of the can body, and the layer covering the metal base is formed to allow a portion where the layer covering the metal base is formed and a portion where the layer covering the metal base is not formed to be adjacent each other in a circumferential direction of the can body.

8. A printing device that performs printing on a can body cylindrically formed with a metal material to be used for a beverage can, the printing device comprising:

a layer forming unit for forming a first ink layer on an outer circumferential surface of the can body by use of an inkjet head having a plurality of ink ejection ports and capable of controlling whether or not an ink is ejected for each of the plurality of ink ejection ports, the first ink layer covering a metal base appearing on the outer circumferential surface; and an image forming unit for forming an image on the outer circumferential surface of the can body after the first ink layer covering the metal base has been formed by the layer forming unit, wherein the layer forming unit is configured to form a second ink layer of an ink of the same color as the first ink layer covering the metal base by attaching the ink to a part of the first ink layer covering the metal base after the first ink layer covering the metal base has been formed to increase a thickness of the part of the first ink layer covering the metal base, and the image forming unit is configured to form an image onto both the portion where the thickness is increased by the second ink layer on the first ink layer covering the metal base and the portion where the thickness is not increased by the second ink layer on the first ink layer covering the metal base.

9. The printing device according to claim 8, wherein the layer forming unit forms the first ink layer covering the metal base by use of an ultraviolet curable ink.

10. The printing device according to claim 8, wherein a plurality of inkjet heads for forming the first ink layer covering the metal base are provided.

11. A beverage can comprising:

a can main body portion cylindrically formed with a metal material;

a layer formed on part of an outer circumferential surface of the can main body portion to cover a metal base appearing on the outer circumferential surface of the can main body portion; and an image layer formed on the outer circumferential surface of the can main body portion, wherein the layer covering the metal base is formed to allow a portion where the layer covering the metal base is formed and a portion where the layer covering the metal base is not formed to be adjacent each other in a circumferential direction of the can main body portion.

12. The beverage can according to claim 11, wherein an ink layer of an ink of the same color as the layer covering the metal base is attached is formed onto a part of the layer covering the metal base to increase a thickness of the part of the layer covering the metal base, and an image is formed onto both of a portion where the thickness is increased by the ink layer on the layer covering the metal base and a portion where the thickness is not increased by the ink layer of the layer covering the metal base.

* * * * *